US008827510B2

(12) United States Patent
Benhammou

(10) Patent No.: US 8,827,510 B2
(45) Date of Patent: Sep. 9, 2014

(54) ELECTROMAGNETIC SUCTION ELEMENT COMPRISING A LIGHT SOURCE

(75) Inventor: Jacob Benhammou, La Queue en Brie (FR)

(73) Assignee: Digit Societe par Actions Simplifiee, Pantin (FR)

( * ) Notice: Subject to any disclaimer, the term of this patent is extended or adjusted under 35 U.S.C. 154(b) by 202 days.

(21) Appl. No.: 13/377,595

(22) PCT Filed: Jun. 8, 2010

(86) PCT No.: PCT/FR2010/000414

§ 371 (c)(1),
(2), (4) Date: Dec. 12, 2011

(87) PCT Pub. No.: WO2011/010005

PCT Pub. Date: Jan. 27, 2011

(65) Prior Publication Data

US 2012/0079689 A1 Apr. 5, 2012

(30) Foreign Application Priority Data

Jul. 22, 2009 (FR) ..... 09 03609

(51) Int. Cl.
*F21V 21/00* (2006.01)

(52) U.S. Cl.
USPC ..... 362/398; 362/382; 292/251.5

(58) Field of Classification Search
USPC ..... 362/398; 292/251.5
See application file for complete search history.

(56) References Cited

U.S. PATENT DOCUMENTS

| | | | | |
|---|---|---|---|---|
| 4,763,937 | A * | 8/1988 | Sittnick et al. | 292/251.5 |
| 5,065,136 | A | 11/1991 | Frolov et al. | |
| 5,496,079 | A | 3/1996 | Frolov | |
| 2009/0174553 | A1 | 7/2009 | Chang | |

FOREIGN PATENT DOCUMENTS

| | | |
|---|---|---|
| FR | 2865230 | 7/2005 |
| WO | 2007/051236 | 5/2007 |

* cited by examiner

*Primary Examiner* — Sean Gramling
(74) *Attorney, Agent, or Firm* — Renner, Kenner, Greive, Bobak, Taylor & Weber

(57) ABSTRACT

The invention relates to an electromagnetic suction element (3) comprising a light source (10) consisting of a prismatic electromagnet (6) housing in a profiled element having a U-shaped section with ends that are closed by end caps (8) each having a shoulder (8*a*). Said suction element is characterized in that the end cap at the end of the suction element at least comprising the light source consists of a translucent material.

6 Claims, 3 Drawing Sheets

PRIOR ART

ELECTROMAGNETIC SUCTION ELEMENT COMPRISING A LIGHT SOURCE

The present invention relates to improvements to electromagnetic suction elements, more particularly those adapted to be surface-mounted.

The suction element is comprised of a prism-shaped electromagnet, arranged under a box open on one side to allow contact with the counterplate.

The aforementioned box is formed by a U-shaped profiled element, having a U-shaped cross-section, whose length is greater than that of the electromagnet for housing various electronic components required for proper functioning of the suction element, the space thus provided being closed by a lid. The assembly is completed by end caps, each, in the form of a prism, fitting into the U-shaped profiled element and comprising a shoulder that limits penetration in said profiled element, in which it is held by screws.

The caps are made of an injected plastic material.

The suction element is complemented by a low power light source for indicating the electrical state of the suction element.

This source is comprised of a light-emitting diode or LED, whose light rays leave the box through an opening provided on the flange of the profiled element, the end of said LED extending out of said box.

Experience has shown that, regardless of the position of the suction element (whether vertical or horizontal at the upper portion of the door), the light emitted by the LED is not very visible from a distance and requires, in order to be seen by an observer, in particular the monitoring staff, that the latter be positioned substantially in the plane of the partition comprising the suction element.

Added to this is the fact that the opening provided on the flange of the profiled element, whose diameter is necessarily on the order of several millimeters, promotes undesired acts of vandalism.

The present invention, which overcomes these disadvantages, is characterized in that the cap, arranged at the end of the suction element comprising the LED, is made of a translucent material.

In this way, the cap, in addition to its usual function of sealing the ends of the suction element, also serves to scatter the light in a horizontal plane, this light, although emitted by a low power source, being clearly visible to an observer located in front of the door, the end portion of the suction element appearing in the form of a thick line of light.

The present invention will be better understood from the following description, with reference to the annexed drawings, provided by way of example only, and in which.

Figure 1:
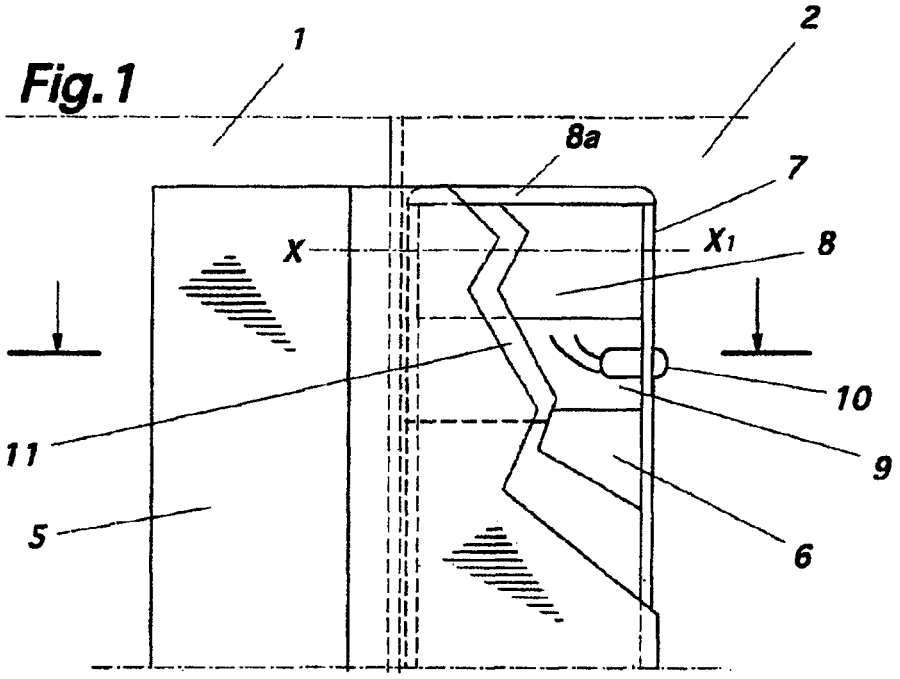
FIG. 1 is a front view of a door showing the use of a known suction element.

Referring to the drawings, the figures schematically show a door 1 and the partition 2 comprising the opening closed by said door.

The suction element 3 is fixed, surface-mounted against the partition 2 and can cooperate with a counterplate 4 attached to the inner surface of a mounting element 5 having a substantially Z-shaped cross-section. The door opens by pulling inward to move it along the arrow F.

The electrical portion of the suction element 3 is comprised of a prism-shaped electromagnet 6 housed in a U-shaped profiled element 7, whose length is greater than that of said electromagnet so as to provide, at the ends of said profiled element, a space 9 that is sufficient to engage blocking end caps 8. These end caps are held by screws, whose axes are schematically illustrated by the reference numerals $XX_1$.

The space 9 also makes it possible to house the components that are necessary to power a LED 10. This space is closed by a lid 11 attached by any suitable means.

The profiled element 7 has an opening 12 in which the LED is arranged.

The figures, which are drawn substantially to scale 1, show that access to the LED is particularly easy with all of the drawbacks this presents.

Experience has shown that the light delivered by the LED is visible to an observer only from a restricted angle. Practically, if one refers to FIG. 2, the latter should be positioned to the right of the suction element and should be close to the partition 2.

The present invention, which overcomes these disadvantages, is characterized in that the end cap 8, located on the side of the LED 10, is made of an injection molded translucent material, and in that the suction element is attached so as to extend slightly beyond the upper edge 5*a* of the element supporting the counterplate 4.

In this way, the shouldered end of the end cap is visible from all angles.

The translucent end cap of the invention is made with the same tools as the previous ones, that is to say, it comprises holes, cavities, channels that are necessary for the passage of attachment screws and especially for avoiding the presence of overly large solid masses which would be incompatible with the injection molding technique.

Surprisingly and unexpectedly, the transparent end cap acts like a light guide that promotes the diffusion of light up to its shouldered upper portion and increases the visual effect.

Figure 2:
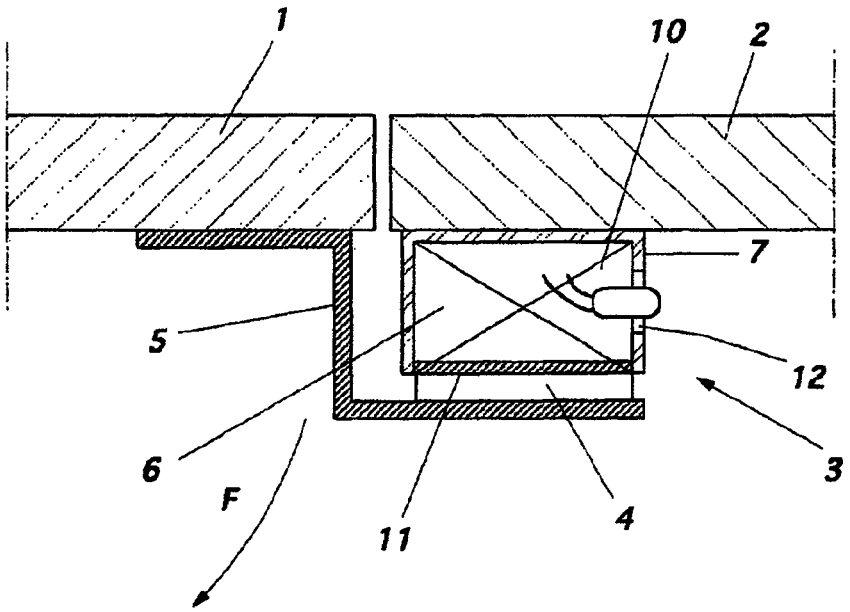
PRIOR ART Fig. 2
FIG. 2 is a cross-sectional view taken along the line II-II of Figure I.
Figure 3:
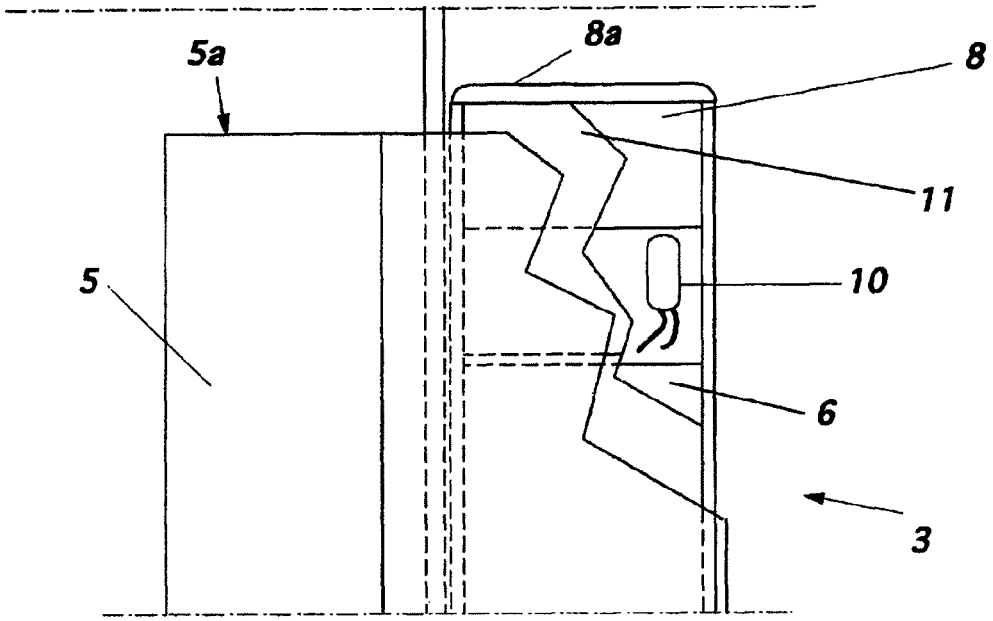
FIG. 3 is a view similar to that of FIG. 1 showing the use of the suction element of the invention.
Figure 4:
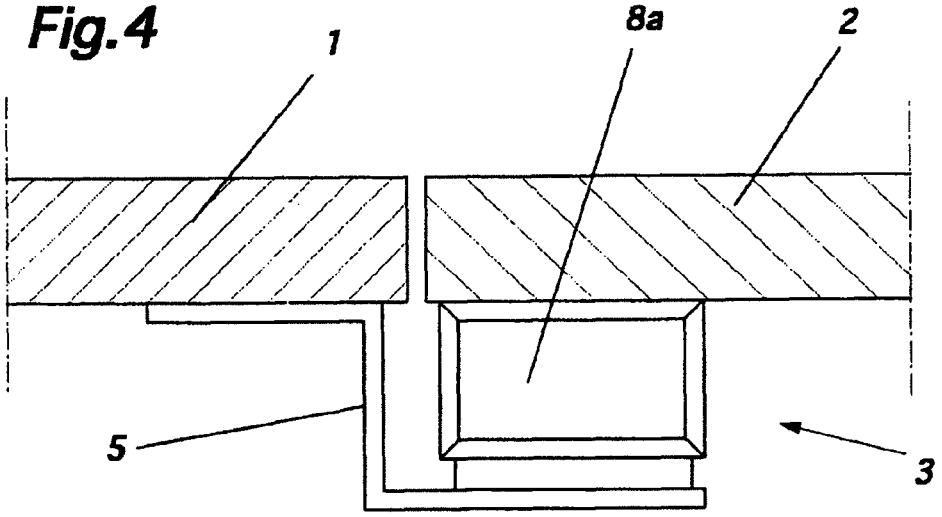
FIG. 4 is the top view of FIG. 3.

Added to this is the fact that it is no longer necessary to provide a wide opening in the profiled element (such as that 12 in FIG. 2).

The machining of the profiled element 7 is simplified, and the LED is fully protected against vandalism.

Figure 5:
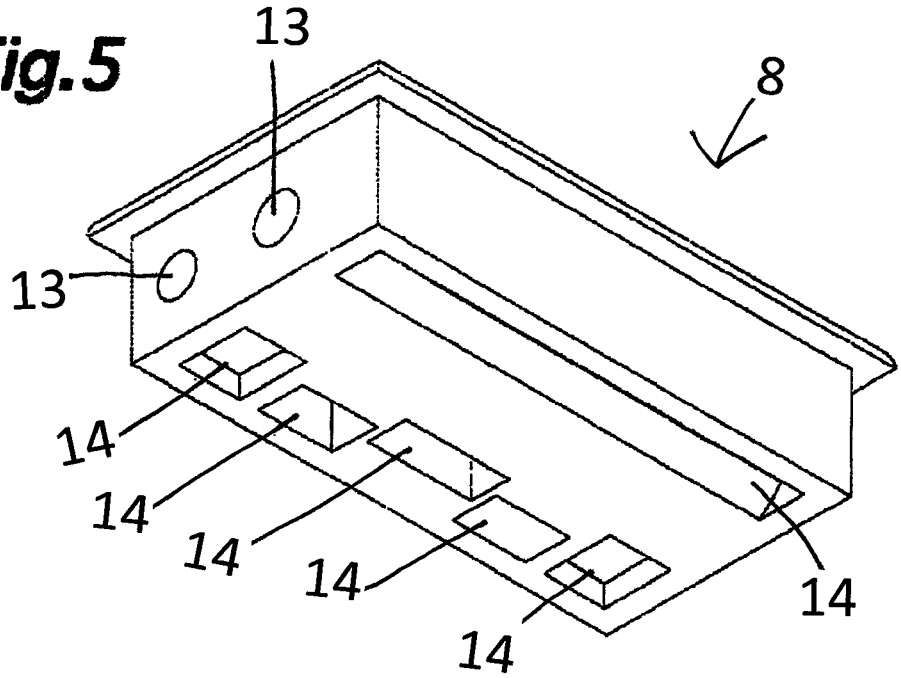
FIGS. 5 and 6 are perspective views of an end piece shown from different angles.
Figure 6:
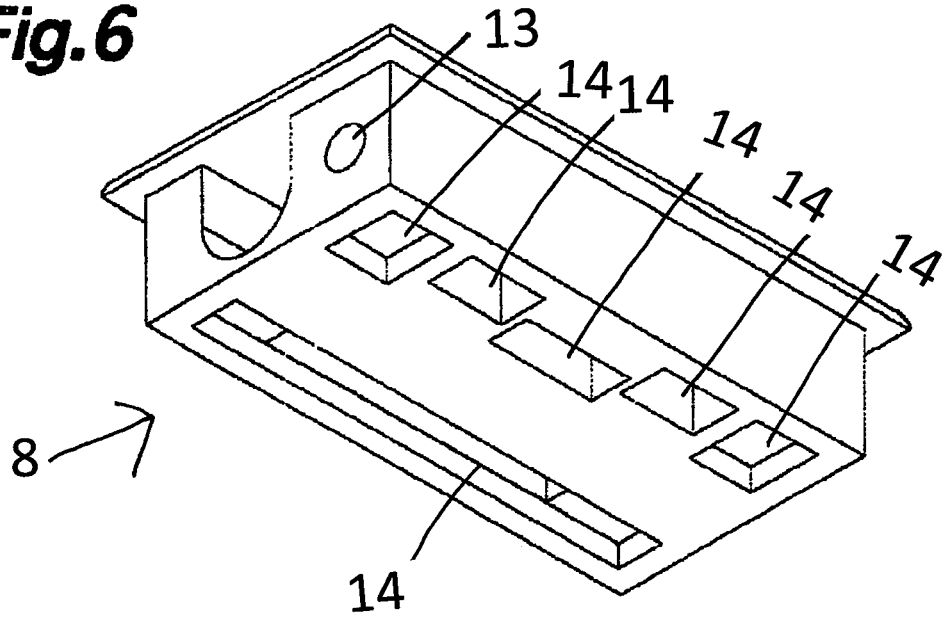

FIG. 5 shows a perspective view from the left end of the end cap 8 and FIG. 6 shows a perspective view from the right end of the end cap 8. The circular holes 13 allow for the end cap 8 to be screwed to the profiled element 7. The recesses 14 formed in the lower part of the end cap 8 make the end cap 8 lighter and easier to manufacture.

The invention claimed is:

1. Door closing electromagnetic suction element assembly, comprising: an electromagnetic suction element in the form of a profiled element in which are house a light source and an electromagnet, said light source being disposed at an upper end of said profiled element; at least one cap closing said upper end of said profiled element where said light source is disposed; a counterplate magnetically attracted against said suction element so as to close the door, said counterplate being surface mounted on a mounting element; and wherein said at least one end cap is made of a translucent material and extends at least in part beyond the upper edge of the surface of the mounting element on which the counterplate is surface mounted.

2. The door closing electromagnetic suction assembly of claim 1, wherein said end cap comprises a shouldered portion which extends beyond the upper edge of the surface of the mounting element on which the counterplate is surface mounted.

3. The door closing electromagnetic suction assembly of claim 1, wherein said light source is fully protected inside said profiled element.

4. The door closing electromagnetic suction assembly of claim 1, wherein said profiled element is a U shaped element having a U shaped cross section.

5. The door closing electromagnetic suction assembly of claim 1, wherein said mounting element has a Z shaped cross section.

6. The door closing electromagnetic suction assembly of claim 1, wherein a length of said U shaped profiled element is greater than that of said electromagnet so as to provide at the upper end of said profiled element a space sufficient to engage said at least one end cap.

* * * * *